US007278494B2

(12) United States Patent
Williams

(10) Patent No.: US 7,278,494 B2
(45) Date of Patent: Oct. 9, 2007

(54) STRIPPER RUBBER INSERT ASSEMBLY

(76) Inventor: John R. Williams, 4500 Williams Dr., #212-404, Georgetown, TX (US) 78628

( * ) Notice: Subject to any disclaimer, the term of this patent is extended or adjusted under 35 U.S.C. 154(b) by 0 days.

(21) Appl. No.: 11/605,945

(22) Filed: Nov. 28, 2006

(65) Prior Publication Data

US 2007/0125548 A1 Jun. 7, 2007

Related U.S. Application Data

(63) Continuation of application No. 10/783,450, filed on Feb. 20, 2004, now Pat. No. 7,237,618.

(51) Int. Cl.
*E21B 33/03* (2006.01)
*E21B 33/068* (2006.01)

(52) U.S. Cl. ..... 166/387; 166/84.1; 166/84.3; 277/324; 277/343

(58) Field of Classification Search ..... 166/387, 166/84.1, 84.3; 277/324, 343
See application file for complete search history.

(56) References Cited

U.S. PATENT DOCUMENTS 4,254,962 A * 3/1981 Blackwell ..... 277/335
4,441,551 A * 4/1984 Biffle ..... 166/84.3
5,062,479 A * 11/1991 Bailey et al. ..... 166/84.3
6,129,152 A * 10/2000 Hosie et al. ..... 166/384

* cited by examiner

*Primary Examiner*—David Bagnell
*Assistant Examiner*—Shane Bomar
(74) *Attorney, Agent, or Firm*—Matthew Burr; Moster Wynne

(57) ABSTRACT

A high-pressure stripper rubber provides inserts and support members that cooperatively support the profile of the rubber against elastic deformation. The inserts dynamically cooperate to resist elastic deformation of the rubber due to down hole pressure. The stripper rubber has a generally cylindrical upper moiety and a dynamic, generally frusto-conical, lower moiety that cooperatively define a bore for receiving oilfield equipment. A generally ring-shaped adapter insert, at least partially within the stripper rubber, is disposed toward the upper moiety for attaching the stripper rubber to drilling head equipment. A structural retention insert assembly provides (1) one or more support members proximately, movably and selectively attached to the adapter insert, and (2) one or more structural retention inserts at least partially within the stripper rubber and distally attached to the one or more support members. The stripper rubber dynamically forms a self-actuating, fluid-tight seal around varying outer diameters of oil field equipment as the equipment is tripped through the stripper rubber bore with minimal deformation of the rubber, even under high pressure.

7 Claims, 6 Drawing Sheets

STRIPPER RUBBER INSERT ASSEMBLY

CROSS-REFERENCE TO RELATED APPLICATIONS

The present application is a continuation of and claims priority from U.S. patent application Ser. No. 10/783,450 now U.S. Pat. No. 7,237,618 entitled STRIPPER RUBBER INSERT ASSEMBLY by the present inventor and filed Feb. 20, 2004.

FIELD OF THE INVENTION

This invention relates to a long-lasting, deformation-resistant, rubber or elastomer-based seal having a construction for dynamically sealing against tubular members or drillstring components movable longitudinally through the seal. In particular, the invention relates to stripper rubbers, and insert assemblies for stripper rubbers, used with rotating control heads, rotating blowout preventers, diverter/preventers and the like, in oil, gas, coal-bed methane, water or geothermal wells.

BACKGROUND OF THE INVENTION

In the drilling industry, seals are used in various applications including rotating blowout preventers, swab cups, pipe and Kelly wipers, sucker rod guides, tubing protectors, stuffing box rubbers, stripper rubbers for coiled tubing applications, snubbing stripper rubbers, and stripper rubbers for rotating control heads or diverter/preventers. Stripper rubbers, for example, are utilized in rotating control heads to seal around the rough and irregular outside diameter of a drillstring of a drilling rig.

Stripper rubbers are currently made so that the inside diameter of the stripper rubber is considerably smaller (usually about one inch) than the smallest outside diameter of any component of a drillstring. As the components move longitudinally through the interior of the stripper rubber, a seal is continuously affected.

Stripper rubbers affect self-actuating fluid-tight seals in that, as pressure builds in the annulus of a well, and in the bowl of the rotating control head, the vector forces of that pressure bear against the outside surface or profile of the stripper rubber and compress the stripper rubber against the outside surface of the drillstring, thus complementing resilient stretch fit forces already present in the stripper rubber. The result is an active mechanical seal that increases sealability as well bore pressure increases.

Well pressure forces often distort the elastic profile of a stripper rubber, deforming the shape from that of a cone to that of a donut. Lowering an oil tool through the stripper rubber often causes the deformed, rolled up, rubber to temporarily uncurl, but the rubber soon returns to the deformed donut shape once it is re-pressurized. Wear and tear on the stripper rubber occurs, therefore, not only from frictional forces between the rubber and a longitudinally moving oil tool, but from the mechanical forces acting on the rubber as it rolls up and unrolls during drilling operations.

Stripper rubbers seal around rough and irregular surfaces of varying diameters such as those found around a drill pipe, tool joints, and a Kelly, and are operated under well drilling conditions where strength and resistance to wear are very important attributes. When using a stripper rubber in a rotating control head, the longitudinal location of the rotating control head is fixed due to the mounting of a stripper rubber onto a bearing assembly that allows the stripper rubber to rotate with the Kelly or drillstring but which restrains the stripper rubber from longitudinal, axial, movement. Relative longitudinal movement of the drillstring, including the end to end coupling areas of larger diameter joints and the larger diameter of tools that bear against a stripper rubber, cause wear of the interior surface of a stripper rubber.

Wear and tear upon a stripper rubber from frictional and mechanical forces will, over a period of time, cause a thinning or weakening of the elastic material to the point that the stripper rubber will fail. Such wear is enhanced or increased when multiple lengths of a drillstring are moved through the stripper rubbers, such as when a drillstring is "tripped" into or out of the well.

There remains a long-standing problem of wear in seals and wipers used for drilling components. Wear is caused by relative movement of a drillstring or production well component against the rubber seal or wiper. Wear is present in all drilling and production applications where a rubber seal or wiper is subjected to the relative movement of a component such as drillstring tools, Kelly, pipe, or rod for the purpose of sealing, wiping, stripping, snubbing and/or packing off well fluids when drilling or producing oil or gas from a well. There remains a long-felt need for a rubber seal or wiper that is resistant to wear, will withstand the greater bore hole pressures of modern wells, and is capable of a longer service life than has been heretofore possible.

BRIEF DESCRIPTION OF THE DRAWINGS

The present invention is further described in the detailed description that follows, by reference to the noted drawings by way of non-limiting examples of embodiments of the present invention, in which like reference numerals represent similar parts throughout several views of the drawings, and in which.

DETAILED DESCRIPTION OF THE INVENTION

In view of the foregoing, the present invention, through one or more of its various aspects, embodiments and/or specific features or sub-components, is thus intended to bring out one or more of the advantages that will be evident from the description. The present invention is described with frequent reference to stripper rubber inserts. It is understood that a stripper rubber insert is merely an example of a specific embodiment of the present invention, which is directed generically to resilient substrate inserts within the scope of the invention. The terminology, therefore, is not intended to limit the scope of the invention.

Long lasting stripper rubbers have been a long felt need in the industry. The advantage of a longer lasting stripper rubber is not only one of safety, but also one of expense since a longer lasting stripper rubber will reduce the number of occasions when the stripper rubbers must be replaced, an expensive and time consuming undertaking.

A further consideration is the tremendous bore hole pressures encountered in modern drilling. Technology enables drilling to depths that were never before possible. A challenge of modern drilling is to control the great and variable pressures of deep reserves. The present invention provides stripper rubbers and stripper rubber insert assemblies that maintain a fluid-tight seal around the drill string even under the pressures of modern deep wells.

Figure 1:
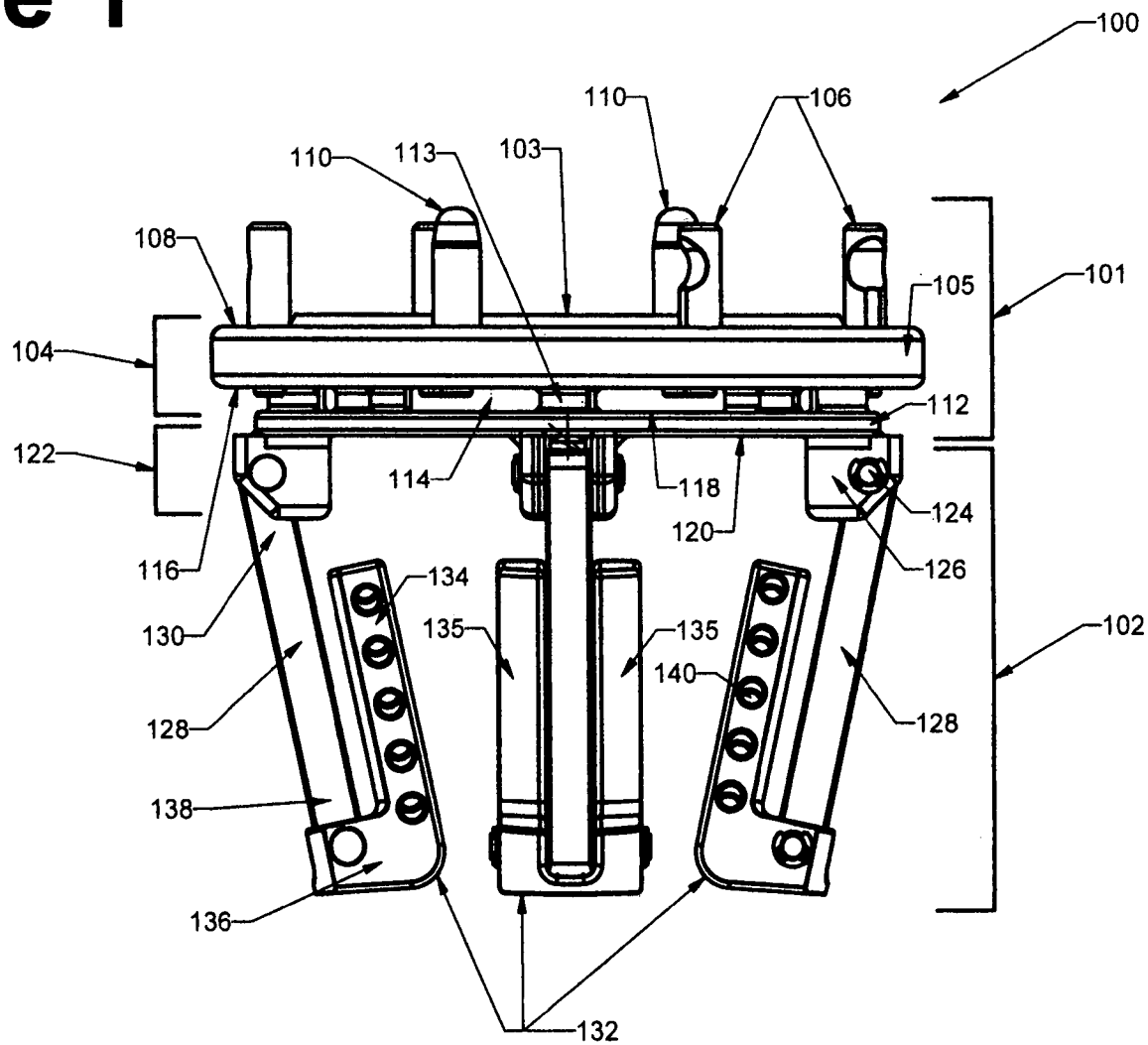
FIG. 1 is a side view schematic drawing of a stripper rubber insert assembly of the present invention.

Referring to the drawings, FIG. 1 is a side view schematic drawing of a stripper rubber assembly of the present invention. Stripper rubber 100 is depicted without the elastic sealing material, or other resilient substrate in which the various inserts are at least partially embedded, in order to view the "cage" formed by the assembly of inserts provided by the present invention.

Typical of many stripper rubbers, stripper rubber 100 has a generally cylindrical or ring-shaped upper moiety 101 for connecting stripper rubber 100 to substantially tubular drilling head equipment mounted above the stripper rubber, and generally frusto-conical lower moiety 102, which sealingly engages around pipe or other drilling equipment 107 passing or extended through the stripper rubber bore 103.

Stripper rubber adapter insert 104 includes top ring 105. One or more cam pins 106, positioned around and extending from top surface 108 of top ring 105, mate with one or more corresponding cam pin bores in a piece of drilling head equipment or other connecting member (not shown). In certain embodiments, top ring 105 also includes guide pins 110 extending from surface 108 to facilitate mating of cam pins 106 with corresponding guide pin bores in the connecting member (not shown) or equipment (not shown).

Insert 104 also includes generally cylindrical or ring-shaped bottom ring 112, separated from top ring 105 by annular space 114. Bottom ring 112 is attached to top ring 105 by spacers 113 welded to the bottom surface 116 of top ring 105 and to the top surface 118 of bottom ring 112. During production, fluid elastic material such as rubber, or any suitable resilient substrate, fills annular space 114 so that, upon resilient hardening of the substrate, bottom ring 112 becomes mechanically embedded in the material and thus becomes an insert.

An alternative embodiment (not shown) of insert 104 is a single, unitary, ring that provides a mechanical equivalent of annular space 114 by means of slots or other perforations machined or molded at least partially through the ring. The present invention further contemplates inserts equivalent to insert 104 but that are substantially solid. That is, such inserts do not provide an equivalent to annular space 114 or other at least partial perforations. Experience, however, demonstrates that providing at least partial perforations or voids in the stripper rubber inserts is recommended in order to achieve a strong mechanical bond between the resilient substrate and the inserts of the stripper rubber.

Continuing with FIG. 1, one or more hinges 122 are positioned around and suspended from bottom surface 120 of bottom ring 112. In a specific embodiment, hinge 122 includes hinge pin 124 reciprocally pivotally disposed through stationary hinge bracket 126. Hinge 122 (or hinge bracket 126) may be attached to surface 120 by welding, bolting, screwing or by any other effective means, or may be unitary with surface 120.

Cantilever support member 128, such as a rod, bar, plane or other suitable structure, reciprocally pivotally suspended at proximate end 130 of support member 128 from hinge 122, descends axially from hinge 122. In a specific embodiment, Support member 128 is at least partially external to the elastic sealing material (not shown) of the stripper rubber. In another embodiment, support member 128 is selectively attachable and detachable at its proximate end 130 to hinge 122. An advantage of this last embodiment is that the stripper rubber may be fabricated with the inserts (that is, the adapter insert and the structural retention inserts) embedded in the resilient substrate such that the support members may be attached to the inserts subsequent to fabrication of the stripper rubber but prior to field use of the stripper rubber. In fact, the support members may be attached to the stripper rubber at the drilling head or platform.

Structural retention insert 132 provides structural retention portion 134 and connection portion 136. Structural retention portion 134 is disposed substantially within the elastic sealing material and may be shaped in the general form of a "U" having two prongs 135 that extend axially upward from connection portion 136. Each prong 135 provides one or more bores 140. During manufacture, fluid elastic such as thermoplastic or rubber fills bores 140 and the space between prongs 135 so that, upon hardening of the elastic material, structural retention insert 132 is at least partially embedded in the rubber to form an insert.

Connection portion 136 extends at least partially external to the elastic sealing material (not shown) or is otherwise accessible externally from the resilient substrate. In a specific embodiment of the present invention, connection portion 136 removably connects to distal end 138 of cantilever support member 128. In another specific embodiment, insert 132 is pivotally attached to cantilever support member 128 to provide some "play" between insert 132 and cantilever support member 128 during dilation or contraction of the insert cage. Such play relieves mechanical stresses between the two elements to reduce the likelihood of failure of the joint between them.

Figure 2:
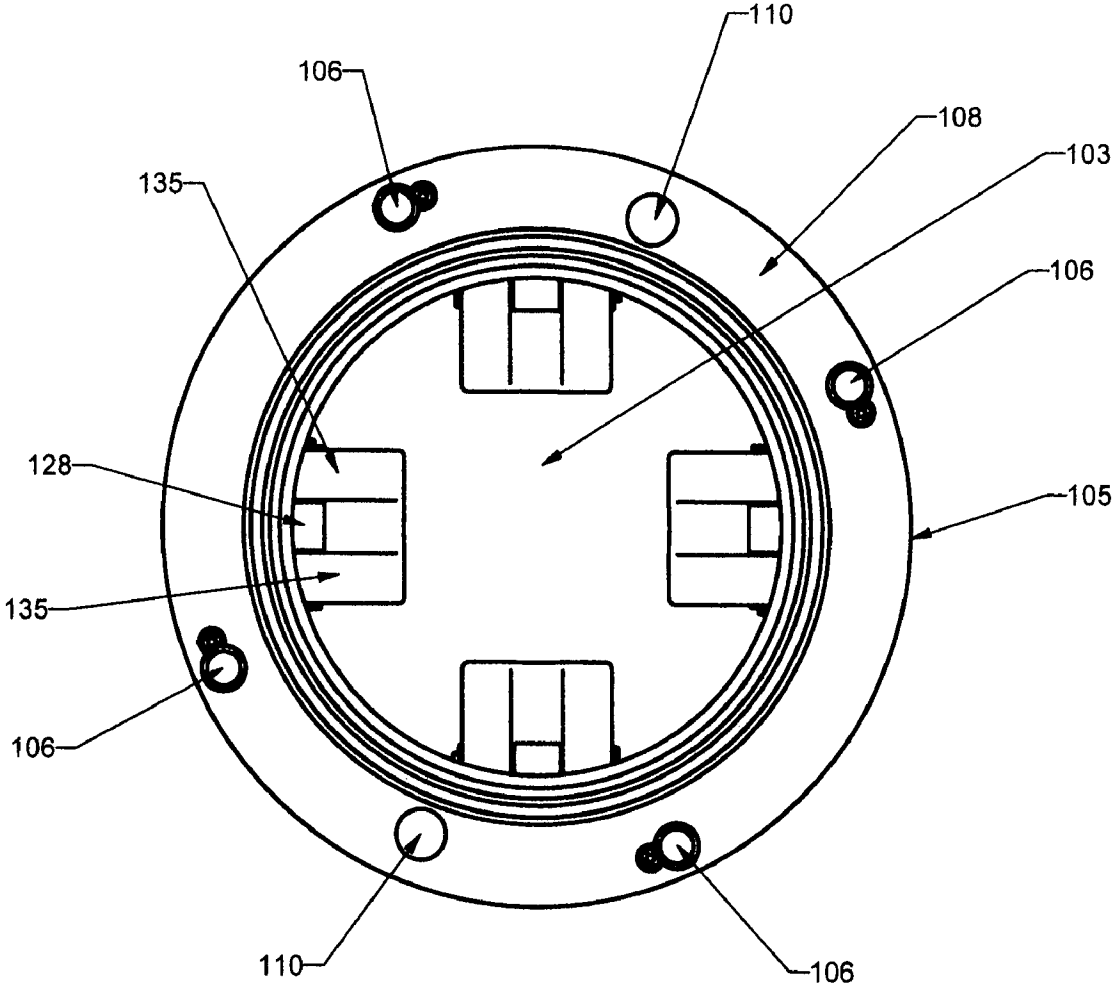
FIG. 2 is a top view schematic drawing of a stripper rubber assembly of the present invention.

FIG. 2 is a top view schematic drawing of a stripper rubber assembly of the present invention. Top ring 105 defines bore 103 and has top surface 108. Disposed around top surface 108 are one or more cam pins 106 and optional cam pin guides 110. Distal end 138 of cantilever rod (support member) 128 can be seen from this view between the proximate ends of prongs 135 of structural retention insert 132.

Figure 3:
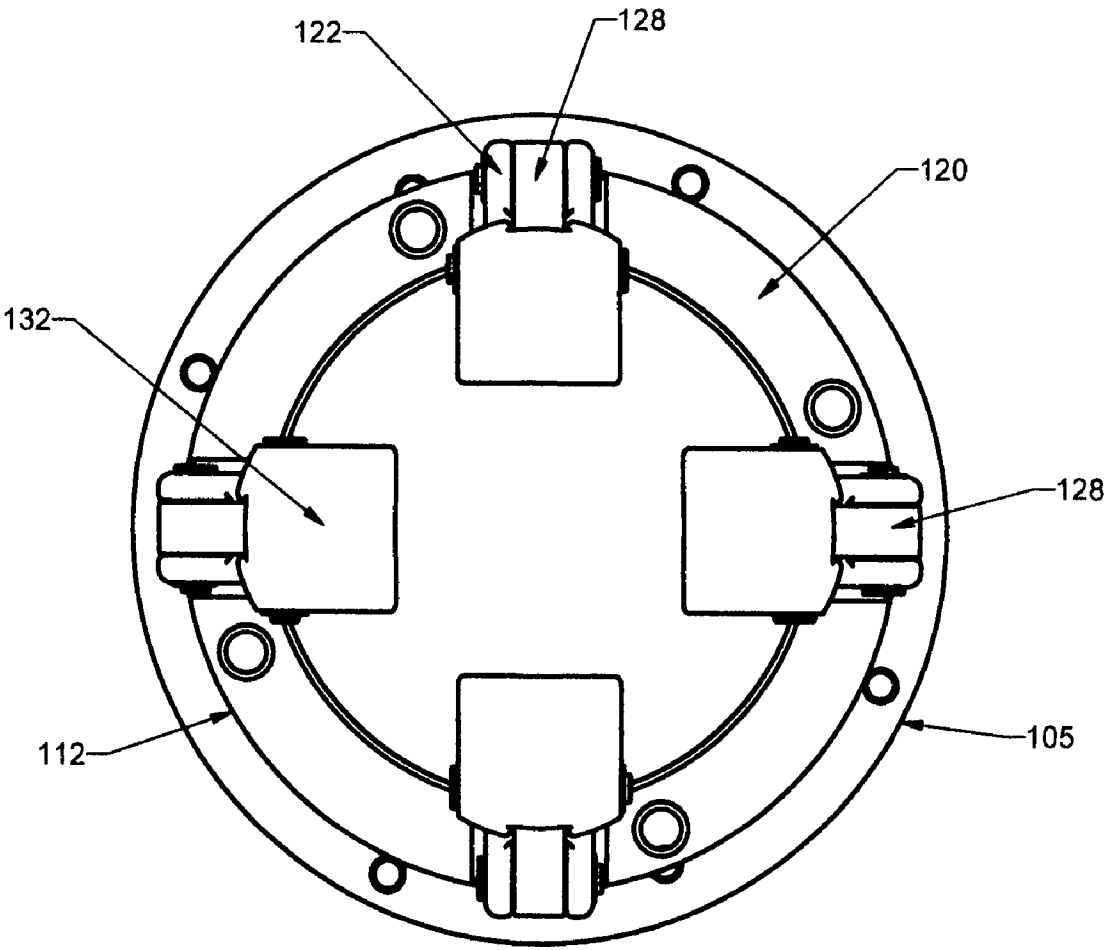
FIG. 3 is a bottom view schematic drawing of a stripper rubber assembly of the present invention.

FIG. 3 is a bottom view schematic drawing of a stripper rubber assembly of the present invention. Insert 104 bottom ring 112 has a smaller outer diameter than top ring 105. One or more hinges 122 are attached to bottom surface 120 of bottom ring 112. The distal end of cantilever rod 128 is seen from this view, connected to retention insert 132.

Figure 4:
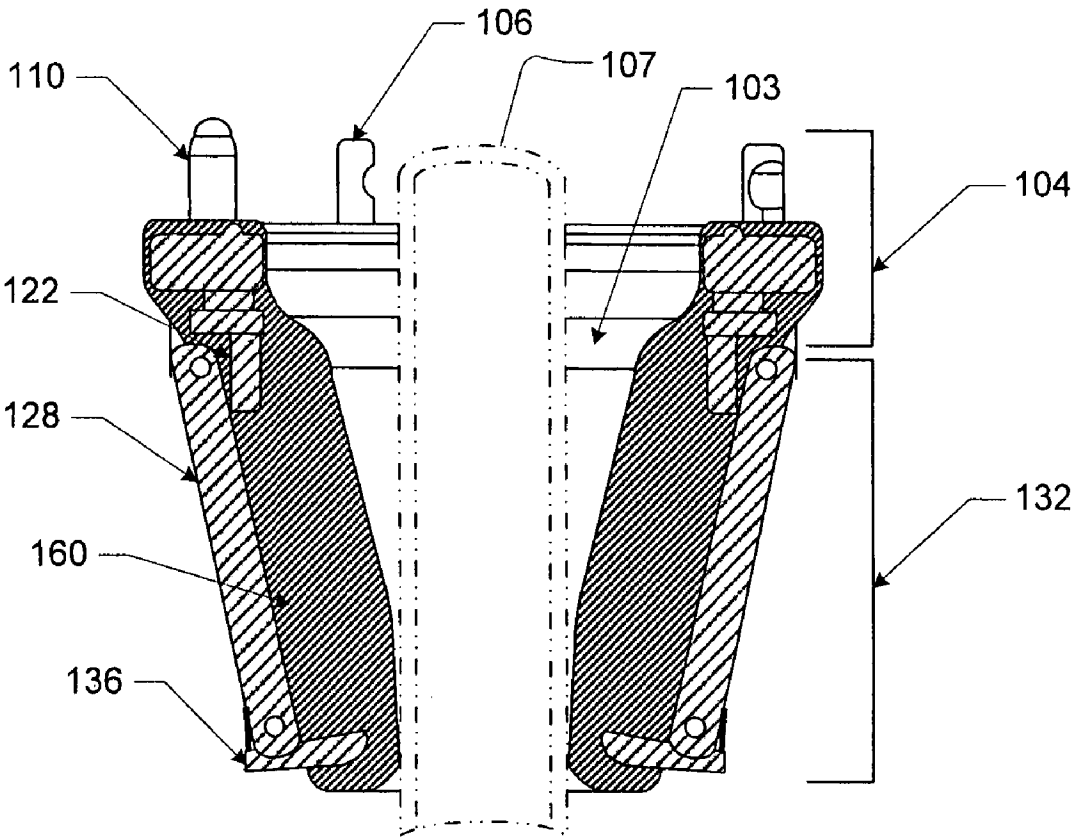
FIG. 4 is a cross-sectional schematic view of the stripper rubber insert assembly of FIG. 1, including the resilient substrate in which the assembly is inserted.

FIG. 4 is a cross-sectional view of the stripper rubber insert assembly of FIG. 1. Resilient substrate sealing element 160 conforms around well head equipment 107 disposed through bore 103. Inserts 104 and 132 of the assembly are at least partially disposed within resilient substrate sealing element 160. Cantilever rods 128 and cam pins 106 extend at least partially out of resilient substrate 160, whereas hinge 122 and retention insert connector portion 136 are at least partially embedded in resilient substrate 160.

Figure 5:
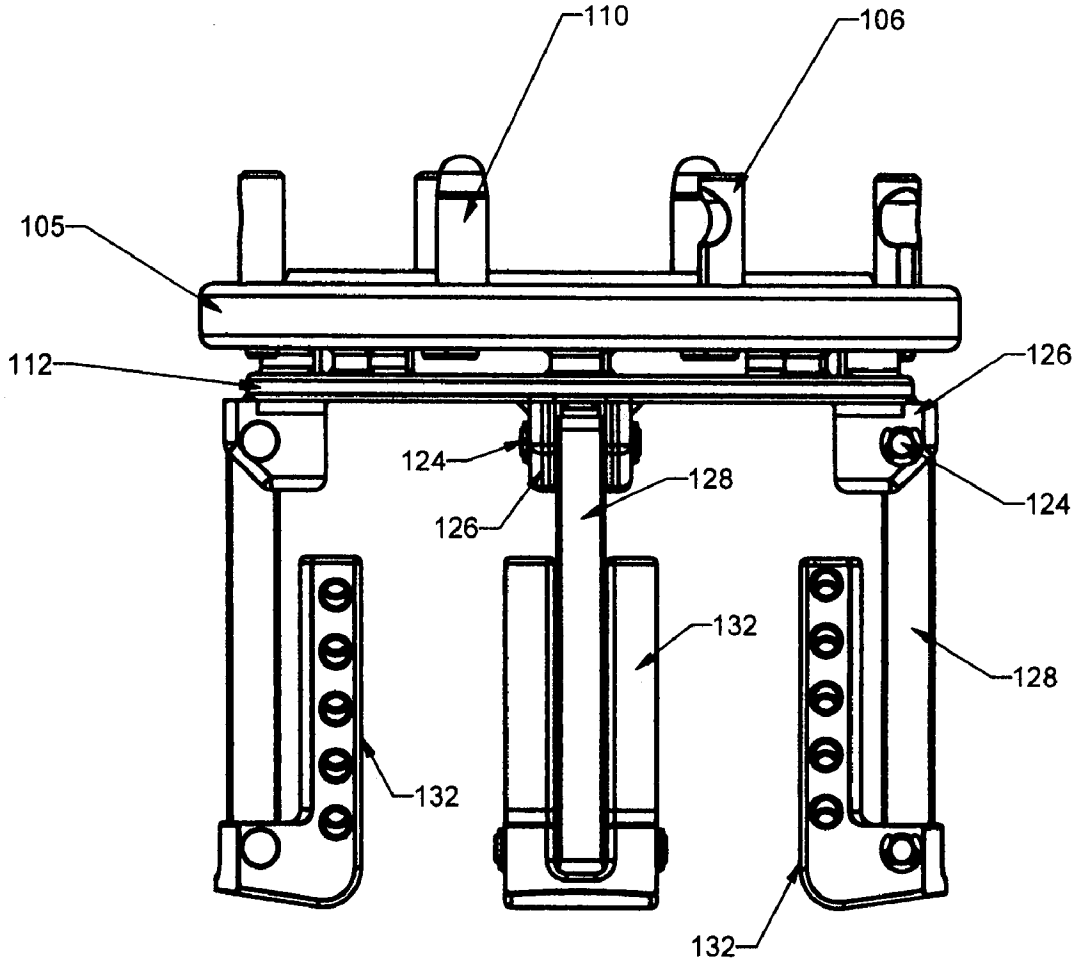
FIG. 5 is a perspective view of a stripper rubber insert assembly of the present invention depicting the structural retention assembly of FIG. 1 in a dilated posture.

FIG. 5 is a perspective side view of a stripper rubber insert assembly of the present invention depicting the structural retention assembly of FIG. 1 in a dilated posture. In FIG. 1, the assembly is contracted to seal around a relatively small outer diameter tube received by bore 103. In FIG. 5, cantilever rods 128 have pivoted outward from hinges 122 as the resilient substrate sealing element 160 is dilated or stretched radially outward to accommodate a tube or tube joint having a relatively large outer diameter.

Figure 6:
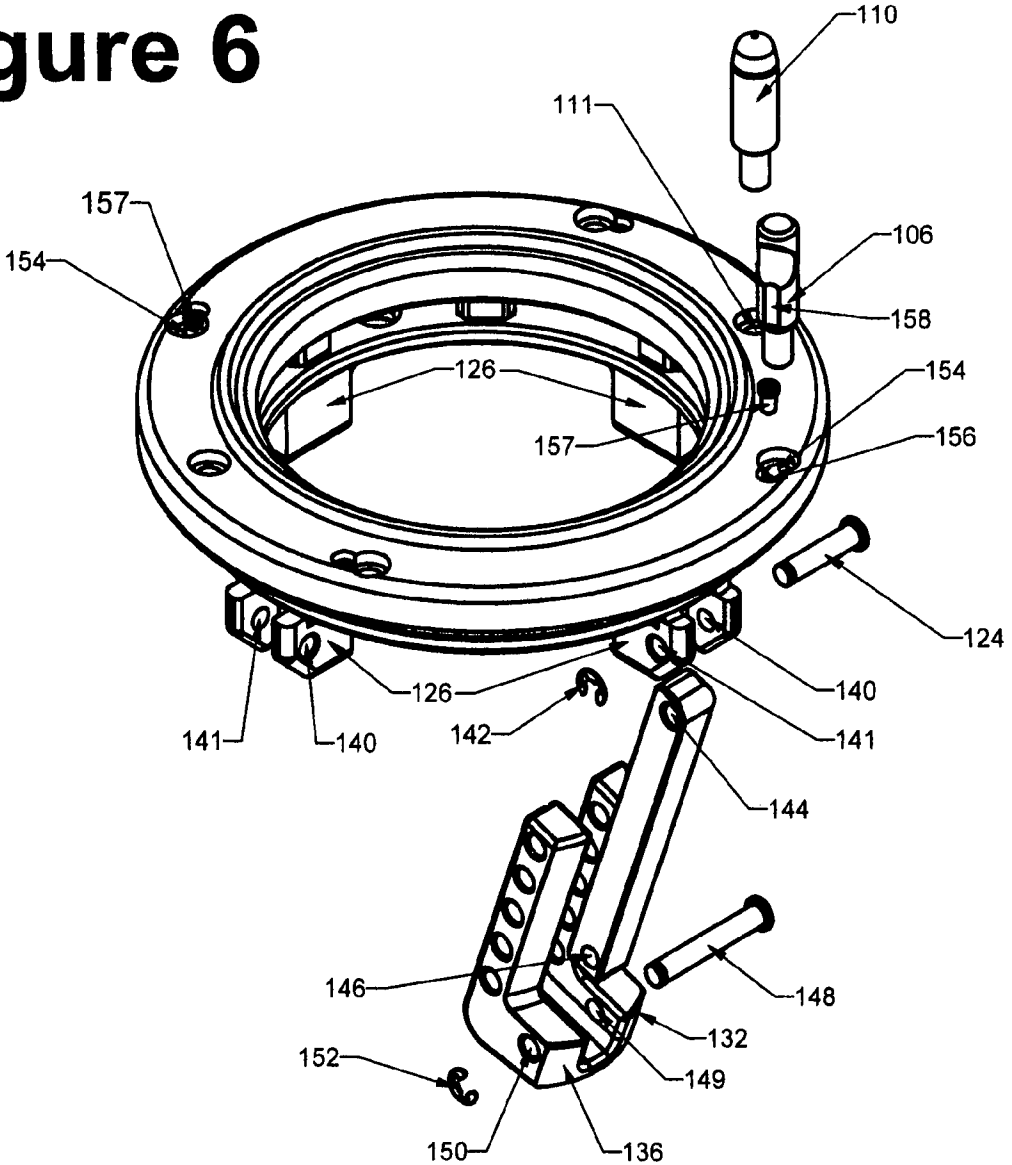
FIG. 6 is an exploded perspective view schematic drawing of a stripper rubber insert assembly of the present invention.

FIG. 6 is an exploded perspective view schematic drawing of a stripper rubber insert assembly of the present invention. Guide pin 110 connects to top ring 105 in guide pin bore 111. Cam pin 106 is disposed in cam pin bore 154 such that groove 158 engages stop pin 157, disposed in stop pin bore 156.

Hinge 122 is obtained from the cooperative interaction of hinge bracket 126, which has bracket hinge pin holes 140, 141, with hinge pin 124 disposed through bracket hinge pin holes 140, 141 and retained therein with e-clip 142.

Cantilever rod 128 provides proximate rod hinge pin hole 144 so that when rod 128 is mounted on bracket 126, hinge pin 124 is cooperatively disposed through rod hinge pin hole 144, together with bracket hinge pin holes 140, 141, to provide pivotal attachment of the proximate end of rod 128 to hinge 122. Cantilever rod 128 further provides distal rod hinge pin hole 146 to receive distal rod pin 148 through holes 149, 150 for pivotal attachment of the distal end of rod 128 to connection portion 136 of structural retention insert 132. Pin 148 is secured in position with e-clip 152.

The present invention provides a stripper rubber that includes, but is not limited to, inserts at least partially disposed within a dynamic elastomer such as rubber. A generally cylindrical upper moiety and a dynamic generally frusto-conical lower moiety of the stripper rubber cooperatively define a bore for receiving oil field equipment such as a drillstring. A generally ring-shaped adapter insert at least partially within the stripper rubber is disposed toward the upper moiety of the stripper rubber. Cam pins extending from the top of the adapter insert mate with corresponding cam pin bores in a connector or other drilling head equipment.

A structural retention insert assembly, attached to the adapter insert, provides one or more rods or support members proximately and movably attached to the stripper rubber from, for example, the bottom of the adapter insert, and one or more structural retention inserts at least partially within the stripper rubber and distally attached to the one or more rods. The present invention contemplates metal inserts, composite inserts, synthetic inserts, hardened resin inserts and inserts of any suitable deformation-resistant material.

The stripper rubber of the present invention dynamically forms a fluid-tight, self-actuating seal around varying outer diameters of oil field equipment as the equipment is lowered or raised through the stripper rubber bore. The shape, or profile, of the stripper rubber is supported and reinforced by hinged pivotal engagement of the cantilever support members with the adapter insert and the structural retention inserts while accommodating dynamic radial dilation or contraction of the frusto-conical portion of the stripper rubber whereby the inner diameter of the conical portion dynamically conforms to varying outer diameters of the equipment.

Advantages of the present invention include a stripper rubber that maintains its profile, that is, it resists longitudinal elastic deformation from well bore pressures acting on the resilient substrate. Another advantage of the present invention is a stripper rubber that withstands the high bore hole pressures encountered when drilling modern deep wells. By providing a stripper rubber that withstands high pressure, the present invention enables effective pressure control for high-pressure wells.

Although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in all its aspects. Although the invention has been described with reference to particular means, materials and embodiments, the invention is not intended to be limited to the particulars disclosed; rather, the invention extends to all functionally equivalent technologies, structures, methods and uses, either now known or which become known, such as are within the scope of the appended claims.

I claim:

1. A stripper rubber comprising:

an elastic sealing material having a top and a bottom;

a ring at least partially embedded within the sealing material near the top;

one or more top hinge brackets connected to the ring and extending external to the sealing material;

a plurality of structural retention inserts at least partially embedded in the sealing material near the bottom, at least one of the structural retention inserts having a hinge bracket extending external to the sealing material and aligned with one of the top hinge brackets connected to the ring; and one or more cantilever support members selectively attachable and detachable to one of the top hinge brackets at a first end and selectively attachable and detachable to one of the bottom retention insert hinge brackets at a second end.

2. The stripper rubber of claim 1, wherein the ring comprises a top ring and a bottom ring connected to the top ring by two or more spacers.

3. The stripper rubber of claim 1, wherein at least one of the structural retention inserts comprises one or more perforations.

4. The stripper rubber of claim 1, wherein the ring further comprises one or more cam pins extending external to the sealing material for connecting the stripper rubber to drilling head equipment.

5. The stripper rubber of claim 1, further comprising one or more selectively insertable and removable hinge pins for selectively attaching and detaching at least one of the cantilever support members from at least one of the hinge brackets.

6. The stripper rubber of claim 1, wherein at least one of the top hinge brackets is integral with the ring.

7. A method for assembling an insert for a stripper rubber at a well head, the stripper rubber having an elastic sealing material having a top and a bottom; a ring at least partially embedded within the sealing material near the top; one or more top hinge brackets connected to the ring and extending external to the sealing material; a plurality of structural retention inserts at least partially embedded in the sealing material near the bottom, at least one of the structural retention inserts having a hinge bracket extending external to the sealing material and aligned with one of the top hinge brackets connected to the ring; and one or more cantilever support members selectively attachable and detachable to one of the top hinge brackets at a first end and selectively attachable and detachable to one of the bottom retention insert hinge brackets at a second end; the method comprising: selectively attaching at least one of the cantilever support members to one of the top hinge brackets and to one of the bottom hinge brackets at the first end and second end, respectively, at the well head.

* * * * *